United States Patent [19]

Craig

[11] 4,021,014

[45] May 3, 1977

[54] FORM FOR CONCRETE WALLS

[76] Inventor: William A. Craig, Box 296, R.D. 2, Cheswick, Pa. 15024

[22] Filed: Apr. 12, 1976

[21] Appl. No.: 675,411

[52] U.S. Cl. ..... 249/45; 249/17; 249/47; 249/191; 249/194; 249/164; 249/147; 249/48

[51] Int. Cl.[2] ..... E04G 11/04

[58] Field of Search ..... 249/1, 17, 18, 44, 45, 249/47, 164, 191, 194, 219 W

[56] References Cited

UNITED STATES PATENTS

| | | | |
|---|---|---|---|
| 1,032,419 | 7/1912 | Morrill | 249/20 |
| 1,220,461 | 3/1917 | Rodgers | 249/194 |

FOREIGN PATENTS OR APPLICATIONS

| | | | |
|---|---|---|---|
| 1,204,869 | 1/1960 | France | 249/219 W |
| 316,108 | 3/1934 | Italy | 249/17 |
| 172,974 | 2/1964 | U.S.S.R. | 249/1 |

*Primary Examiner*—Francis S. Husar
*Assistant Examiner*—John McQuane
*Attorney, Agent, or Firm*—Buell, Blenko & Ziesenheim

[57] ABSTRACT

A form for concrete which has inner and outer walls spaced apart. Each wall is formed by a plurality of vertical elements abutting each other vertically. A row of whaler lookout plates are mounted on the abutting sides of the vertical elements and support a whaler rod which holds the vertical elements together to form a wall.

3 Claims, 5 Drawing Figures

Fig. I.
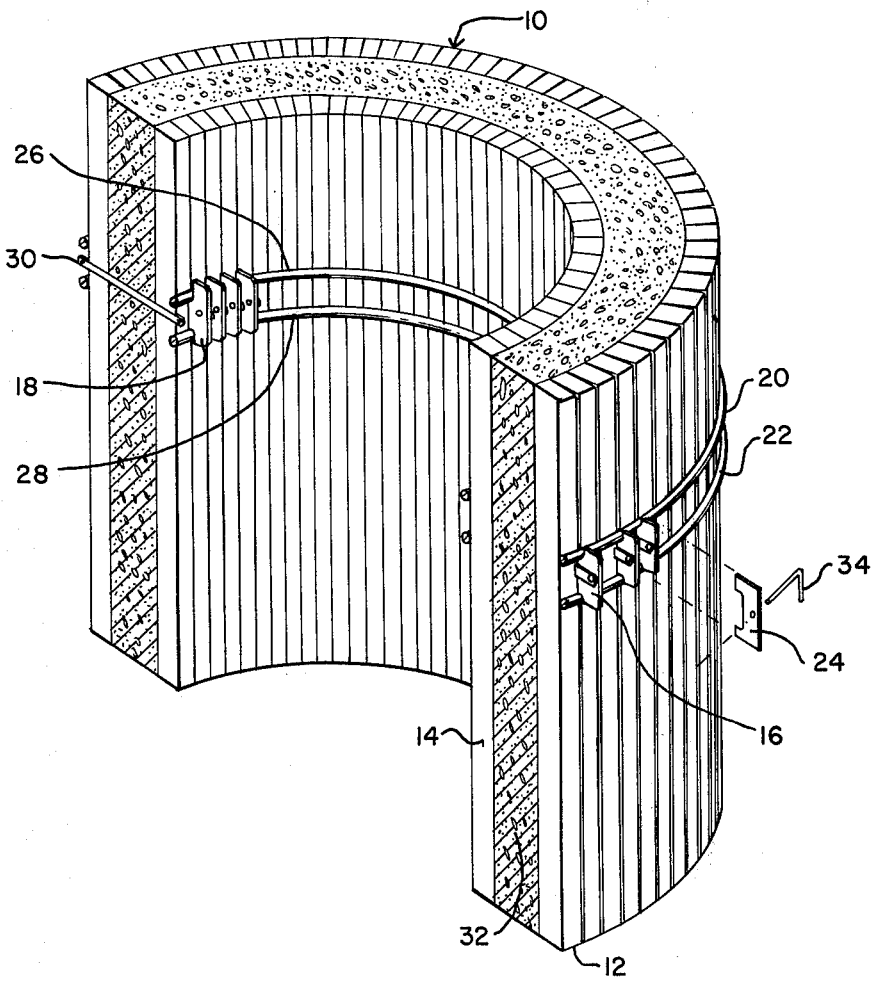

FORM FOR CONCRETE WALLS

PROBLEM AND PRIOR ART

Existing concrete forms particularly those used to build concrete cylindrical tanks are built by using modules. The module concept is satisfactory for large diameter (including rectangular) tanks. However, a problem of economics arises in using the modules for smaller tanks in the range of 8 feet in diameter. The number of pieces required for the smaller diameter tanks increases disproportionately with the decrease in diameter thereby creating a cost burden and a labor burden.

My invention provides a form which is simple to erect and economical from the standpoint of the number of parts required.

I provide a form for concrete comprising a plurality of outer vertical elements each having a vertical longitudinal axis and abutting vertically side-by-side forming an outer wall; a plurality of inner vertical elements each having a vertical longitudinal axis and abutting vertically side-by-side forming an inner wall, the inner wall is horizontally spaced from the outer wall to the desired thickness of the concrete wall; a plurality of outer whaler lookout plates each mounted on the abutting sides of the outer vertical elements and extending from the vertical elements; a plurality of inner whaler lookout plates, each mounted on the abutting sides of the inner vertical elements and extending from the vertical elements; an outer whaler rod supported by the outer whaler lookout plates; and an inner whaler rod supported by the inner whaler lookout plates.

DESCRIPTION OF THE DRAWINGS

FIG. 1 is an isometric view in section of the form showing the concrete;

DETAILED DESCRIPTION OF THE EMBODIMENT OF THE INVENTION

Figure 3:
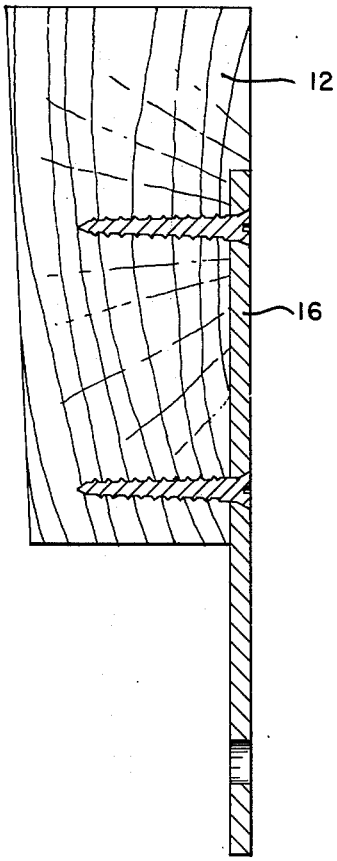
FIG. 3 is a top sectional view of the vertical element and the whaler lookout shown in FIG. 2.

A form generally shown as 10 in FIG. 1 comprises a plurality of outer vertical elements 12 and inner vertical elements 14. These vertical elements can be made of any material, however, the present preferred embodiment is wood commonly referred to as "two-by-fours". The vertical elements 12 and 14 are arranged in a vertical abutting side-by-side relationship and form a wall. Whaler lookout plates 16 and 18 are rabbitted on the abutting sides of outer and inner vertical elements 12 and 14. This is shown in FIG. 3. The inner and outer abutting elements 12 and 14 form walls which are spaced apart. The space is to receive concrete 32. The inner and outer whaler lookout plates 16 and 18 hold top and bottom inner and outer whaler rods 20, 22, 26 and 28. These whaler rods are parallel and held by a row of the whaler lookout plates. To prevent the bottom whaler rods 22 and 28 from falling, C-plates 24 are used on the outer and inner wall. The C-plates are positioned between a pair of whaler lookout plates. A rod pin 34 is inserted in holes within the whaler lookout plates 16 and 18 and the C-plate is held in position. The C-plate engages the bottom whaler rods.

Figure 4:
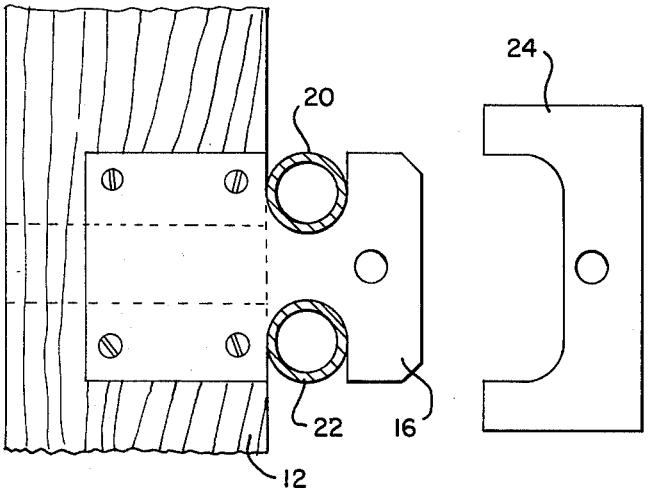
FIG. 4 is a partial side view of the vertical element shown in FIG. 2 showing the whaler lookout, the pair of whaler rods and the C-plate used to hold the bottom whaler rod.
Figure 2:
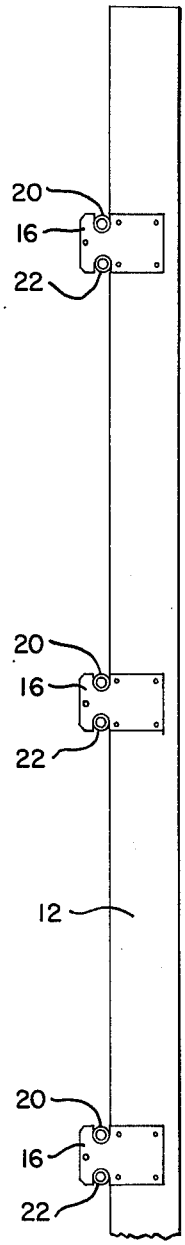
FIG. 2 is an end view of one of the vertical elements that form the walls of the form and showing the whaler lookout plates attached supporting a pair of whalers.
Figure 5:
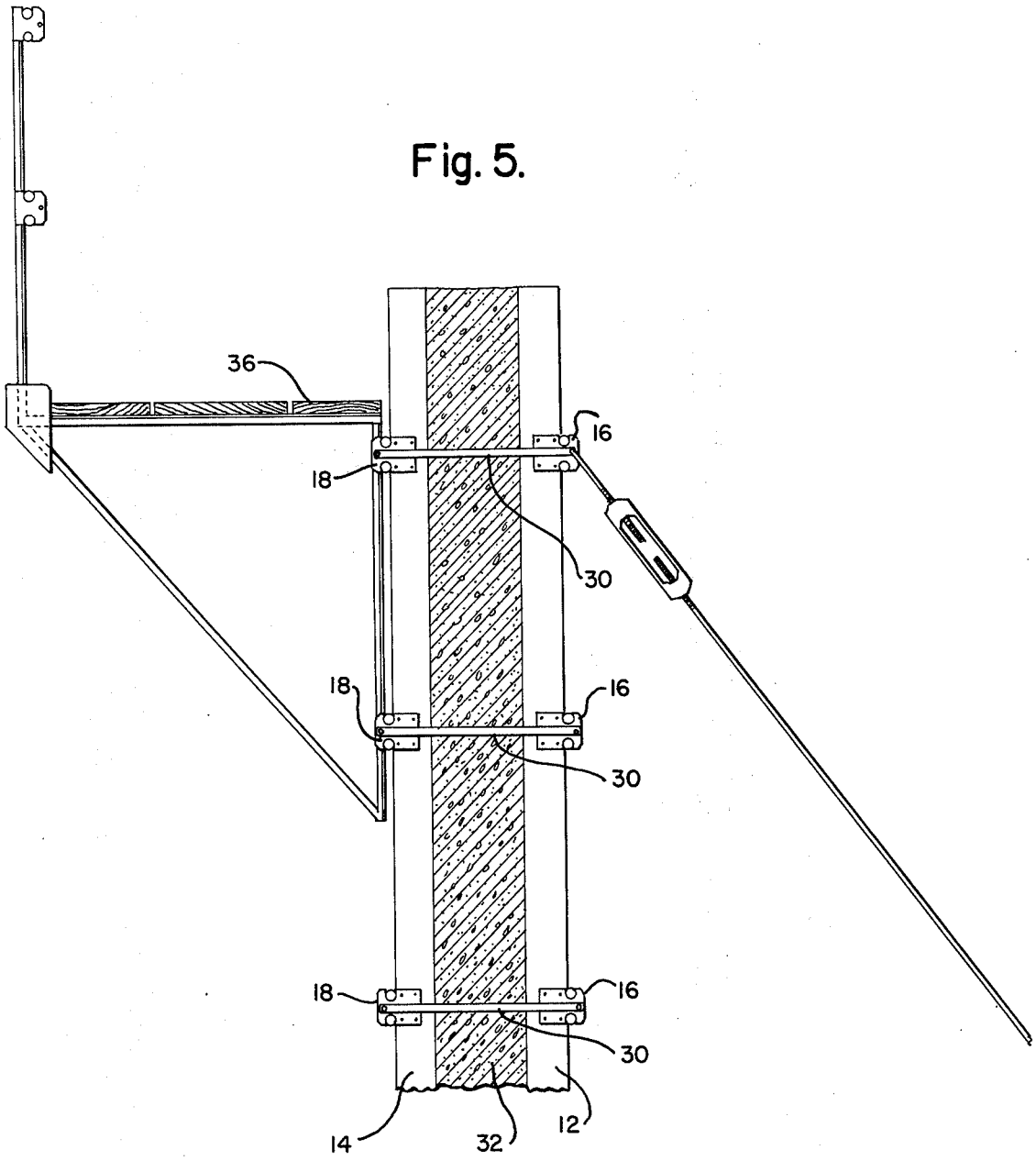
FIG. 5 is an end sectional view of the form with the scaffolding attached.

A tie rod 30 is used to hold the inner and outer walls together to maintain the desired wall thickness of the concrete 32. The tie rods 30 pass between rabbitted sides of the vertical elements 12 and 14. The ends of the tie rods 30 have holes through which rod pin 34 can pass and hold the tie rods 30 in position. The same pin 34 can be used to hold a scaffolding walkway 36 as shown in FIG. 5. The scaffolding includes a structure as shown in the drawing in FIG. 5 which is formed in a triangle. The horizontal member is joined to the vertical member at right angles and the opposite ends of each of those members is joined by a third member. The vertical member is secured to a whaler lookout plate 18 in each row by a suitable means. Additional rows of whaler lookout plates and corresponding whalers can be vertically spaced parallel from other rows along the longitudinal axis of the vertical elements as shown in FIGS. 2 and 5.

The whaler rods and tie rods tie the vertical elements together and give support to the walls. If longer walls are to be used on an existing wall form, additional vertical elements with whaler lookout plates and whalers can be brought into abutting relationship with the existing wall and then joined by rod pins 34.

It must be understood that the form can be used for straight walls as well as those which require a radius for cylindrical concrete tanks.

I claim:

1. A form for a concrete wall comprising:

a. a plurality of outer vertical elements each having a vertical longitudinal axis and abutting vertically side-by-side forming an outer wall;

b. a plurality of inner vertical elements each having a vertical longitudinal axis and abutting vertically side-by-side forming an inner wall, the inner wall is horizontally spaced from the outer wall to the desired thickness of the concrete wall;

c. a row of a plurality of outer whaler lookout plates each mounted on one of the abutting sides of the outer vertical elements and extending from the outer vertical elements in a direction away from the space formed between the inner and outer walls;

d. a row of a plurality of inner whaler lookout plates, each mounted on one of the abutting sides of the inner vertical elements and extending from the inner vertical elements in a direction away from the space formed between the inner and outer walls;

e. a pair of parallel outer whaler rods engaging the outer whaler lookout plates which vertically separate the pair of outer rods;

f. a pair of parallel inner whaler rods engaging the inner whaler lookout plates which vertically separate the pair of inner rods;

g. a plurality of C-plates engaging the pairs of inner and outer whaler rods, each C-plate positioned between adjacent pairs of whaler lookout plates;

h. a plurality of rod pins each passing through aligned holes in the outer and inner whaler lookout plates and the C-plates for securing the C-plates in engagement with the whaler rods; and i. a tie rod passing between two adjacent outer vertical elements and two adjacent inner vertical elements, the tie rod is secured at each end by a rod pin which passes through a hole in the end of the tie rod and holes in a pair of adjacent whaler lookout plates, the end of the tie rod is positioned between the pair of adjacent whaler lookout plates.

2. A form as recited in claim 1 including an additional row of inner whaler lookout plates and an additional row of outer whaler lookout plates mounted on the inner wall and outer wall, respectively each additional row of whaler lookout plates having an additional pair of parallel whaler rods engaging the additional whaler lookout plates, each pair of additional whaler rods are vertically spaced apart by the additional whaler lookout plates and an additional plurality of C-plates engaging the additional pair of whaler rods, each additional C-plate is positioned between an adjacent additional pair of whaler lookout plates and is secured in engagement with the additional whaler rods by a pin passing through aligned holes in the additional C-plate and the additional whaler lookout plates.

3. A form as recited in claim 2 including a scaffolding which is supported by the two rows of outer whaler lookout plates, the scaffolding includes a structure which is formed in a triangle, a first side of the triangle is formed by a vertical member, a second side is formed by a horizontal member which has one end joined to an end of the vertical member at right angles, and a third side is formed by a member which joins the other end of the horizontal member and other end of vertical member, the vertical member is secured to at least one whaler lookout plate in each row by a securing means.

* * * * *